US005971298A

United States Patent [19]

Millan et al.

[11] Patent Number: 5,971,298

[45] Date of Patent: Oct. 26, 1999

[54] MICRO SPRAY GUN

[75] Inventors: Jorge Millan, Lawndale; Arnold Comproni, Sylmar, both of Calif.

[73] Assignee: Northrop Grumman Corporation, Los Angeles, Calif.

[21] Appl. No.: 09/073,209

[22] Filed: May 4, 1998

[51] Int. Cl.[6] ..... B05B 1/28

[52] U.S. Cl. ..... 239/290; 239/422; 239/532; 239/588; 138/DIG. 8

[58] Field of Search ..... 239/8, 11, 290, 239/296, 422, 418, 428, 526, 532, 588; 285/223, 226, 235, 237; 138/DIG. 8, 118

[56] References Cited

U.S. PATENT DOCUMENTS

| | | | |
|---|---|---|---|
| 1,361,526 | 12/1920 | Johns . | |
| 1,425,333 | 8/1922 | Parker et al. . | |
| 1,655,257 | 1/1928 | Binks . | |
| 2,004,303 | 6/1935 | Wahlin | 299/140.1 |
| 2,082,061 | 6/1937 | Jenkins | 299/140.1 |
| 2,107,732 | 2/1938 | Gustafsson et al. | 239/290 |
| 2,438,471 | 3/1948 | Ball | 239/422 |
| 2,553,401 | 5/1951 | Carr | 137/144 |
| 2,577,437 | 12/1951 | Stringer | 239/588 |
| 2,737,415 | 3/1956 | Wheeler-Nicholson | 239/418 |
| 2,743,963 | 5/1956 | Peeps | 299/140.1 |
| 2,959,358 | 11/1960 | Vork | 239/330 |
| 3,120,237 | 2/1964 | Lang | 134/102 |
| 3,344,992 | 10/1967 | Norris | 239/8 |
| 3,396,911 | 8/1968 | Norris | 239/290 |
| 3,589,621 | 6/1971 | Bradley | 239/526 |
| 3,700,174 | 10/1972 | Beck | 239/526 |
| 4,114,812 | 9/1978 | Austin et al. | 239/492 |
| 4,163,511 | 8/1979 | Kecskemethy et al. | 222/144.5 |
| 4,669,508 | 6/1987 | Neaves | 138/121 |
| 4,669,757 | 6/1987 | Bartholomew | 285/138 |
| 5,072,883 | 12/1991 | Vidusek | 239/290 |
| 5,199,644 | 4/1993 | Heferkorn | 239/296 |
| 5,263,646 | 11/1993 | McCauley | 239/154 |
| 5,271,564 | 12/1993 | Smith | 239/532 |
| 5,279,461 | 1/1994 | Darroch | 239/297 |
| 5,322,221 | 6/1994 | Anderson | 239/291 |
| 5,344,078 | 9/1994 | Fritz et al. | 239/296 |
| 5,395,054 | 3/1995 | Wheeler | 239/526 |
| 5,676,310 | 10/1997 | Hynds | 239/8 |

*Primary Examiner*—Andres Kashnikow
*Assistant Examiner*—Lisa Ann Douglas
*Attorney, Agent, or Firm*—Terry J. Anderson; Karl J. Hoch, Jr.

[57] ABSTRACT

In accordance with the present invention, there is provided a high volume, low pressure paint spray gun connectable to a paint source, an atomization air source and a shaping air source. The paint spray gun is provided with a spray gun body which is in fluid communication with the paint source, the atomization air source for atomizing paint and the shaping air source for shaping paint spray patterns. The spray gun is further provided with a nozzle which defines a paint atomizing zone for discharging atomized paint and a paint spray pattern shaping zone shaping atomized paint spray patterns. The spray gun is further provided with a paint hose, atomization air hose, and shaping air hose each having an inlet end which is connected to the spray gun body and a discharge end which is connected to the nozzle. The spray gun is further provided with a bendable, shape-retaining paint conduit having an inlet port which is connectable to the spray gun body and an outlet port which is connectable to the nozzle. The hoses extend through and are contained within the paint conduit. The paint conduit allows the nozzle to be self-supporting for maintaining the paint atomizing and shaping zones remote from and at any angle relative to the spray gun body for selectively discharging atomized paint and shaping resulting paint spray patterns thereof.

18 Claims, 3 Drawing Sheets

MICRO SPRAY GUN

FIELD OF THE INVENTION

The present invention relates generally to paint spray guns, and more particularly to a high volume, low pressure spray gun having a bendable shape-retaining paint conduit.

BACKGROUND OF THE INVENTION

In recent years, there has been an ever increasing industry and legislative drive towards increasing the transfer efficiency of fluid materials sprayed from pressurized spray guns. Transfer efficiency can be defined as the amount of sprayed fluid material, such as paint, that goes onto subject parts as compared to the amount lost to overspray and bounceback. A high transfer efficiency decreases fluid material consumption reduces undesirable deposits on adjacent surfaces, and results in relatively less overspray which improves operator visibility. Importantly, transfer efficiency is a measure of the amount of fluid material dispersed into the ambient air which contributes to environmental pollution.

One class of spray gun uses pressurized air for atomizing liquid material and for shaping the envelope or pattern of the atomized liquid material as it is discharged from a nozzle assembly on the gun. Air atomization spray guns broadly fall into two classes. One type of air atomization spray gun uses a low volume flow of high pressure air (LVHP) for atomization and pattern shaping. The air pressure in such guns may typically be in the 40 psi to 100 psi range. The transfer efficiency associated with such guns, however, are far from optimal. This is due to the relatively high air pressures which produces a high degree of overspray and bounceback.

The other broad type of spray gun which uses pressurized air for atomizing liquid material employs a high volume, low pressure (HVLP) spray approach in order to increase fluid material transfer efficiency. The transfer efficiency of HVLP spray guns is much greater than the LVHP spray guns. HVLP atomization utilizes a high volume of air typically delivered at 10 psi or less to atomize fluid material. It is the large volume of air passing in contact with a fluid material in a suitable nozzle assembly which causes atomization of the fluid material.

Many industries have adopted the HVLP approach, either voluntarily or by legislative mandate. For example, currently the Southern California Air Quality Management District's rules and the EPA's National Emission Standards for Hazardous Air Pollutants require spray gun air atomization pressure to be no greater than 10 psi.

There are many applications where parts and surfaces are located in confined spaces and need to be coated with a fluid material. This is especially the case in the aerospace industry. For example, often painting is required in and around complex structures within aircraft wings and under aircraft skin panels. Another example is where lines or beads of sealant are required to be applied in confined spaces to parts and surfaces, such as fasteners and joints. Due to the spatial constraints, gaining access to the subject parts or surfaces may present a formidable task to the spray gun operator. Often, the operator must apply fluid material to parts which the operator cannot even see. In addition, when working in such confined spaces, it is desirable to mitigate overspray onto adjacent parts such as electronic gear, wiring, and the like.

It is therefore evident that there exists a need in the art for a high volume, low pressure spray gun which facilitates operation in confined spaces while mitigating overspray and bounceback.

SUMMARY OF THE INVENTION

In accordance with the present invention, there is provided a high volume, low pressure paint spray gun connectable to a paint source, an atomization air source and a shaping air source. The paint spray gun is provided with a spray gun body which is in fluid communication with the paint source, the atomization air source for atomizing paint and the shaping air source for shaping paint spray patterns. As used herein the terms 'paint' and 'paint source' shall refer to paint, coatings, primers, sealants, veneers, and similar fluid or liquid surface preparations. The spray gun is further provided with a nozzle which defines a paint atomizing zone for discharging atomized paint and a paint spray pattern shaping zone shaping atomized paint spray patterns. The spray gun is further provided with a paint hose having an inlet end which is connected to the spray gun body and a discharge end which is connected to the nozzle. The spray gun is further provided with an atomization air hose having an inlet end which is connected to the spray gun body and a discharge end which connected to the nozzle. The spray gun is further provided with a shaping air hose having an inlet end which is connected to the spray gun body and a discharge end which connected to the nozzle. The spray gun is further provided with a bendable, shape-retaining paint conduit having an inlet port which is connectable to the spray gun body and an outlet port which is connectable to the nozzle. The paint conduit is preferably formed of metal. The hoses extend through and are contained within the paint conduit. The paint conduit allows the nozzle to be self-supporting for maintaining the paint atomizing and shaping zones remote from and at any angle relative to the spray gun body for selectively discharging atomized paint and shaping resulting paint spray patterns thereof.

Preferably, the paint conduit is rotably attachable to the spray gun body through the addition of an input coupling for rotably attaching the paint conduit to the spray gun body. Likewise, the paint conduit is rotably attachable to the nozzle through the addition of an output coupling for rotably attaching the paint conduit to the nozzle.

In addition, spray gun body is provided with a paint valve which is in fluid communication with the paint source for selectively controlling paint flow. The spray gun body is further provided with an atomizing air valve which is in fluid communication with the atomizing air source for selectively controlling atomizing air flow. The spray gun body is further provided with a shaping air valve which is in fluid communication with the shaping air source for selectively controlling shaping air flow. The atomizing air valve and the shaping air valve are under common control. The spray gun is further provided with a pressure gauge which is attachable to the spray gun body and in fluid communication with the atomization air hose.

In the preferred embodiment of the present invention, the paint conduit defines a longitudinal axis and has radial diameter along the longitudinal axis which is less than a half of an inch. Likewise, the nozzle defines a longitudinal axis and has a radial diameter along the longitudinal axis which is less than a half of an inch.

In addition, the nozzle is provided with a paint hose fitting, an atomization air hose fitting, and a shaping air hose fitting. Each of the fittings are sized and configured to receive the respective output ends of the paint, the atomization, and the shaping air hoses. The nozzle is further provided with an atomization chamber. The paint and the atomization air hose fittings terminate within the paint atomization chamber, for atomizing paint from the paint source with the atomizing air from the atomizing air source. The nozzle is further provided with a shaping air exit port which is in fluid communication with the shaping air hose fitting. The air hose fitting is sized and configured to direct shaping air in a direction of paint atomized in the paint atomization chamber.

In addition there is provided a method of painting which includes providing the above described paint spray gun. The paint conduit is selectively bended and atomized, shaped paint selectively discharged from the paint spray gun.

As such, based on the foregoing, the present invention mitigates the inefficiencies and limitations associated with prior art paint spray guns. The spray gun of the present invention is particularly adapted to comply with regulatory constraints. The spray gun is a high volume, low pressure device. In this regard, in the preferred embodiment of the present invention, the spray gun is provided with a pressure gauge which may be used to easily monitor the atomization air pressure so as to verify compliance with regulatory constraints.

In addition, the present spray gun is particularly adapted to minimize overspray and bounce back and therefore increase the paint transfer efficiency of the system through the use of the paint conduit. The paint conduit is bendable and shape-retaining so as to maintain the paint atomizing and shaping zones remote from and at any angle relative to the spray gun body for selectively discharging atomized paint and shaping resulting paint spray patterns thereof. As such the paint conduit facilitate remote access of the nozzle to various surfaces and part to be painted. Prior art designs do not necessarily allow the user such freedom of access and thus painting may only be achieved with the nozzle being located remote from the surface to be painted with a corresponding inefficient paint transfer.

Advantageously, the paint conduit is self-supporting. Once the paint conduit is formed into a desired shape, the user need only to support the paint gun body. It is not necessarily required that the use physically hold and support the nozzle. Thus, the spray gun of the present invention truly allows remote access.

Accordingly, the present invention represents a significant advance in the art.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
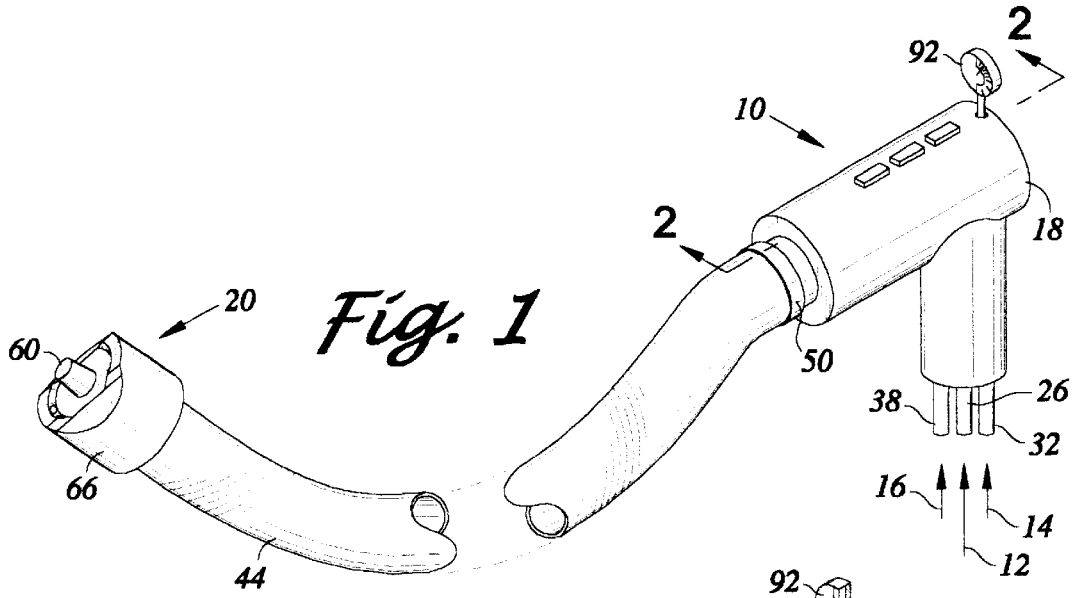
FIG. 1 is a perspective view of the paint spray gun of the present invention.
Figure 2:
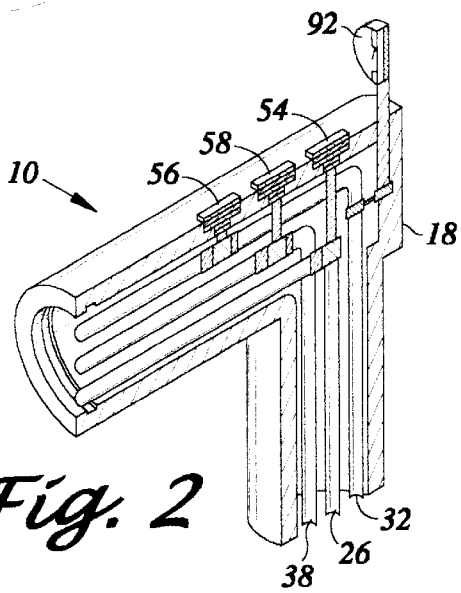
FIG. 2 is a cross-sectional view of the spray gun body.

Referring now to the drawings wherein the showings are for purposes of illustrating a preferred embodiment of the present invention only, and not for purposes of limiting the same, FIGS. 1–7 illustrate a high volume, low pressure paint spray gun which is constructed in accordance with the present invention.

In accordance with the present invention, there is provided a high volume, low pressure paint spray gun 10 connectable to a paint source 12, an atomization air source 14 and a shaping air source 16. The paint spray gun 10 is provided with a spray gun body 18 which is in fluid communication with the paint source 12, the atomization air source 14 for atomizing paint and the shaping air source 16 for shaping paint spray patterns. As used herein the terms 'paint' and 'paint source' shall refer to paint, coatings, primers, sealants, veneers, and similar fluid or liquid surface preparations. The spray gun 10 is further provided with a nozzle 20 which defines a paint atomizing zone 22 for discharging atomized paint and a paint spray pattern shaping zone 24 shaping atomized paint spray patterns. The spray gun 10 is further provided with a paint hose 26 having an inlet end 28 which is connected to the spray gun body 18 and a discharge end 30 which is connected to the nozzle 20. The spray gun 10 is further provided with an atomization air hose 32 having an inlet end 34 which is connected to the spray gun body 18 and a discharge end 36 which connected to the nozzle 20. The spray gun 10 is further provided with a shaping air hose 38 having an inlet end 40 which is connected to the spray gun body 18 and a discharge end 42 which connected to the nozzle 20.

Figure 3:
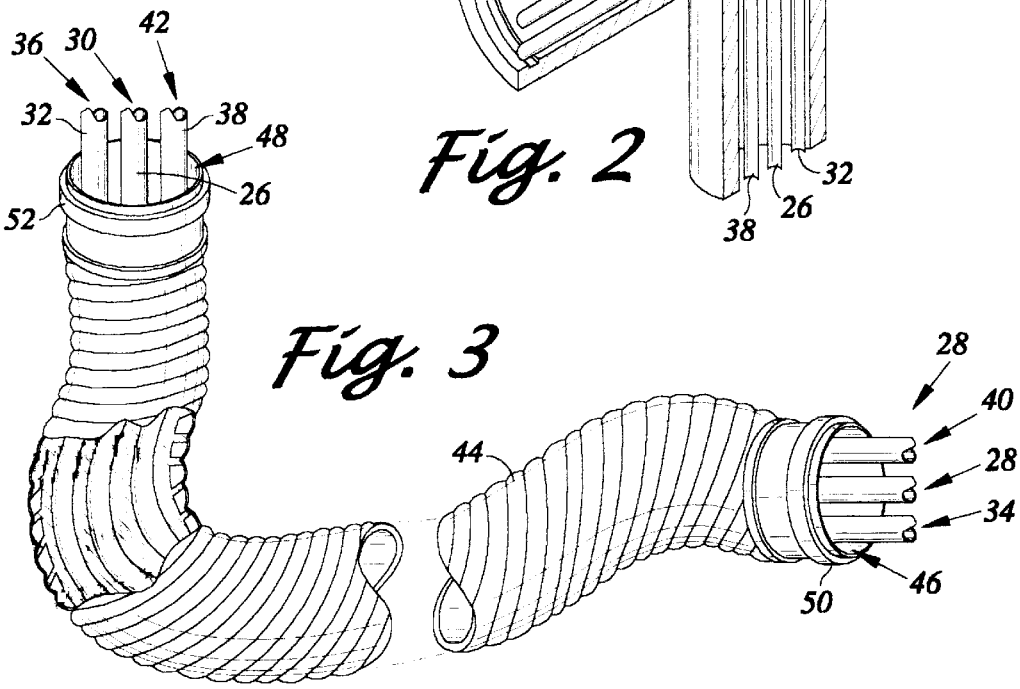
FIG. 3 is a perspective view showing a partial cross-section of the paint conduit as used in the present invention.
Figure 4:
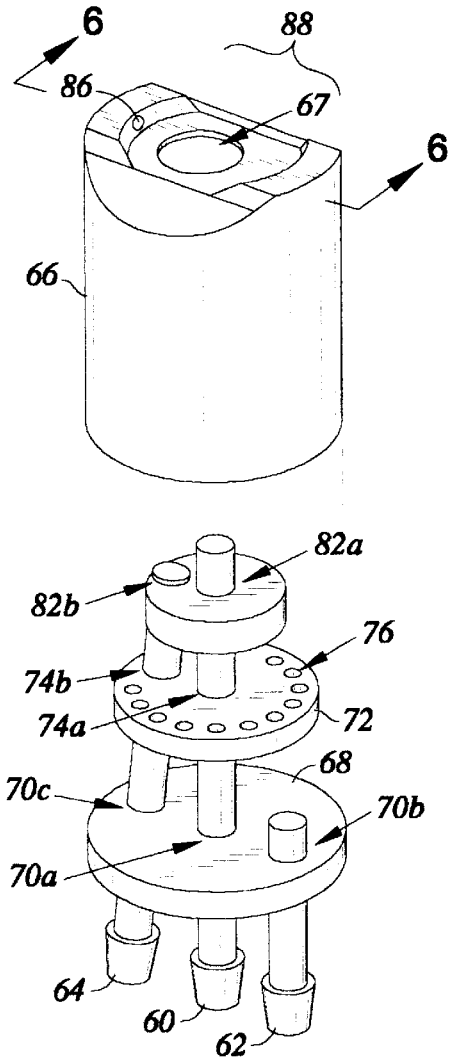
FIG. 4 is an exploded perspective view of the nozzle of the spray gun of the present invention.
Figure 6:
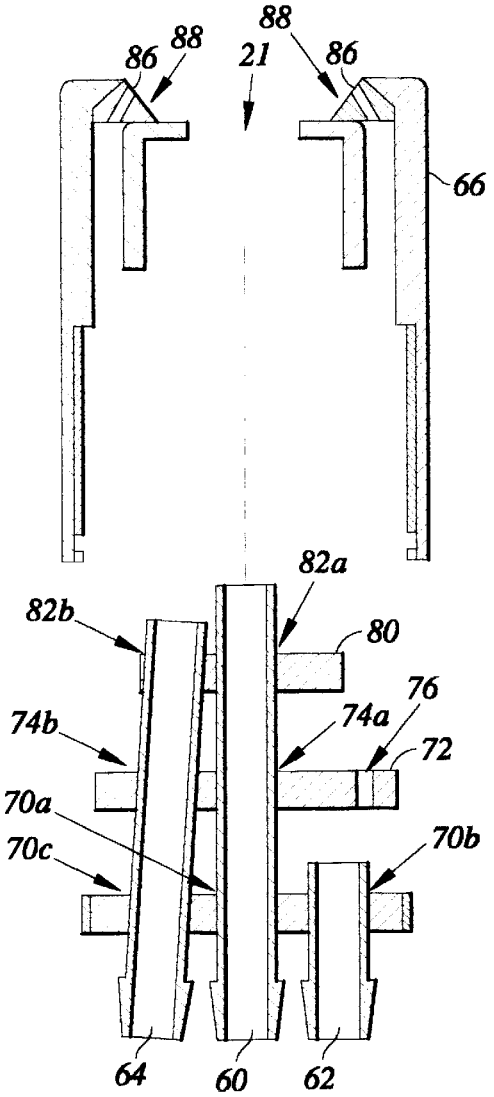
FIG. 6 is an exploded cross-sectional view of the nozzle as seen along axis 6—6 of FIG. 4.
Figure 5:
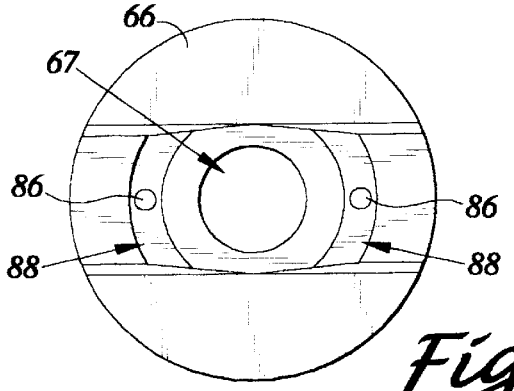
FIG. 5 is a top view of the nozzle as shown in FIG. 4.
Figure 7:
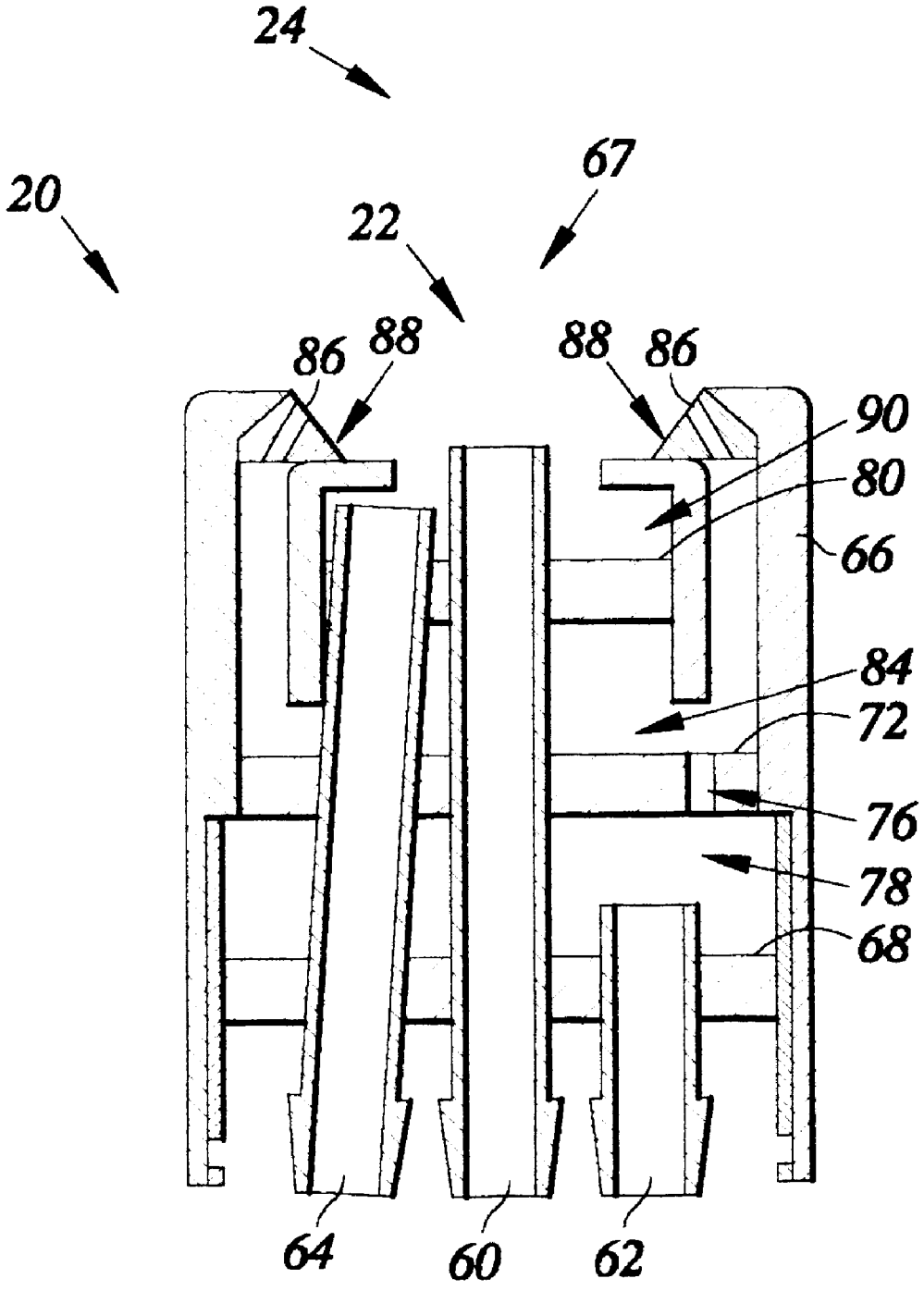
FIG. 7 is an cross-sectional view of the nozzle as used in the present invention.

Referring now to FIG. 3, the spray gun 10 is further provided with a bendable, shape-retaining paint conduit 44 having an inlet port 46 which is connectable to the spray gun body 18 and an outlet port 48 which is connectable to the nozzle 20. The paint conduit 44 is may be formed of metal. It is contemplated that other material types are suitable, such as plastic for example, and are chosen from those well known to one of ordinary skill in the art. An example of a particular type of paint conduit 44 is Loc-Line Modular Hose manufactured by Lockwood Products, Inc. of Lake Oswego, Oreg. The hoses 26, 32, 38 extend through and are contained within the paint conduit 44. The paint conduit 44 allows the nozzle 20 to be self-supporting for maintaining the paint atomizing and shaping zones 22, 24 remote from and at any angle relative to the spray gun body 18 for selectively discharging atomized paint and shaping resulting paint spray patterns thereof. Preferably, the paint conduit 44 is rotatably attachable to the spray gun body 18 through the addition of an input coupling 50 for rotatably attaching the paint conduit 44 to the spray gun body 18. Likewise, the paint conduit 44 is rotably attachable to the nozzle 20 through the addition of an output coupling 52 for rotatably attaching the paint conduit 44 to the nozzle 20.

In addition, spray gun body 18 is provided with a paint valve 54 which is in fluid communication with the paint source 12 for selectively controlling paint flow. The spray gun body 18 is further provided with an atomizing air valve 56 which is in fluid communication with the atomizing air source 14 for selectively controlling atomizing air flow. The spray gun body 18 is further provided with a shaping air valve 58 which is in fluid communication with the shaping air source 16 for selectively controlling shaping air flow. The atomizing air valve 56 and the shaping air valve 58 may be under common control. The spray gun 10 is further provided with a pressure gauge 92 which is attachable to the spray gun body 10 and in fluid communication with the atomization air hose 32.

In the preferred embodiment of the present invention, the paint conduit 44 defines a longitudinal axis and has radial diameter along the longitudinal axis which is less than a half of an inch. Likewise, the nozzle 20 defines a longitudinal axis and has a radial diameter along the longitudinal axis which is less than a half of an inch.

Referring now to FIGS. 4–7, the nozzle 20 is provided with a paint hose fitting 60, an atomization air hose fitting 62, and a shaping air hose fitting 64. Each of the fittings 60, 62, 64 are sized and configured to receive the respective discharge ends 30, 36, 42 of the paint, the atomization, and the shaping air hoses 26, 32, 38. The nozzle 20 is further provided with a nozzle cap 66 which defines a longitudinal axis and is formed to receive and enclose the hose fittings 60, 62, 64. The nozzle cap 66 is provided with a nozzle discharge port 67. The nozzle 20 is further provided with a circular base plate 68 having three holes 70*a–c* for receiving the fittings 60, 62, 64 therethrough. The nozzle 20 is further provided with a diffuser plate 72 having a pair of holes 74*a–b* for receiving the paint hose and atomizing air hose fittings 60, 62 therethrough. In addition the diffuser plate 72 is provided with a plurality of diffuser holes 76. The nozzle cap 66, the base plate 68 and the diffuser plate 72 define a first shaping air chamber 78. The shaping air fitting terminates at the base plate 68 which partially defines the first shaping air chamber 78. The first shaping air chamber 78 is in fluid communication with the shaping air source 14.

The nozzle 20 is further provided with a top plate 80 having a pair of holes formed to receive the paint hose and atomizing air hose fittings 60, 62 therethrough. The nozzle cap 66, the diffuser plate 72 and the top plate 80 define a second shaping air chamber 84. The second shaping air chamber 84 is in fluid communication with the shaping air source 14 as it receive shaping air flow through the plurality of diffuser holes 76. The nozzle cap 66 is provided with a pair of shaping air horns 86 which allow fluid communication with the second shaping air chamber 84 for discharging shaping air therethrough and out of the nozzle 20. The shaping air horns 86 collectively define a shaping air exit port 88. It is contemplated that the second shaping air chamber 84 facilitates a complex mixing of the shaping air flow such that a more uniform shaping air flow discharges through the pair of shaping air horns 86. The nozzle cap 66 and the top plate 80 define a partially open paint atomization chamber 90 with the paint atomization zone 22 substantially co-located thereat. Thus, atomized paint flows through the nozzle discharge port 67 of the nozzle cap 66 and encounters the shaping air flow.

In practice, it is contemplated that paint from the paint source 12 flows through the paint hose fitting 60 into the paint atomization chamber 90 and the atomization air flows through the atomization air hose fitting 62 into the paint atomization chamber 90. The region where the paint and atomization air interact to produce atomized paint defines the atomization zone 22. Once the paint is atomized, shaping air is injected thereat to control paint spray patterns. The region where the atomized paint and the shaping air interact define the shaping air zone 24.

In addition there is provided a method of painting which includes providing the above described paint spray gun 10. The paint conduit 44 is selectively bended and atomized, shaped paint selectively discharged from the paint spray gun 10.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A high volume, low pressure paint spray gun connectable to a paint source, an atomization air source and a shaping air source, the paint spray gun comprising:

a spray gun body in fluid communication with the paint source, the atomization air source for atomizing paint and the shaping air source for shaping paint spray patterns;

a nozzle defining a paint atomizing zone for discharging atomized paint and a paint spray pattern shaping zone shaping atomized paint spray patterns;

a paint hose having an inlet end connected to the spray gun body and a discharge end connected to the nozzle;

an atomization air hose having an inlet end connected to the spray gun body and a discharge end connected to the nozzle;

a shaping air hose having an inlet end connected to the spray gun body and a discharge end connected to the nozzle;

a bendable, shape-retaining paint conduit having an inlet port connectable to the spray gun body and an outlet port connectable to the nozzle, the hoses extending therethrough and contained therein; and wherein the paint conduit allows the nozzle to be self-supporting for maintaining the paint atomizing and shaping zones remote from and at any angle relative to the spray gun body for selectively discharging atomized paint and shaping resulting paint spray patterns thereof.

2. The paint spray gun of claim 1 wherein the paint conduit being rotatably attachable to the spray gun body.

3. The paint spray gun of claim 2 wherein the paint conduit comprises an input coupling for rotatably attaching the paint conduit to the spray gun body.

4. The paint spray gun of claim 1 wherein the paint conduit being rotatably attachable to the nozzle.

5. The paint spray gun of claim 4 wherein the paint conduit comprises an output coupling for rotatably attaching the paint conduit to the nozzle.

6. The spray gun of claim 1 wherein the spray gun body further comprises:

a paint valve in fluid communication with the paint source for selectively controlling paint flow;

an atomizing air valve in fluid communication with the atomizing air source for selectively controlling atomizing air flow; and a shaping air valve in fluid communication with the shaping air source for selectively controlling shaping air flow.

7. The spray gun of claim 6 wherein the atomizing air valve and the shaping air valve being under common control.

8. The spray gun of claim 1 wherein the paint conduit being formed of metal.

9. The spray gun of claim 1 further comprises a pressure gauge attachable to the spray gun body and in fluid communication with the atomization air hose.

10. The spray gun of claim 1 wherein the paint conduit defining a longitudinal axis and having a radial diameter along the longitudinal axis which is less than a half of an inch.

11. The spray gun of claim 1 wherein the nozzle defining a longitudinal axis and having a radial diameter along the longitudinal axis which is less than a half of an inch.

12. The spray gun of claim 1 wherein the nozzle comprises:

a paint hose fitting, an atomization air hose fitting, and a shaping air hose fitting, each sized and configured to receive the respective output ends of the paint, the atomization, and the shaping air hoses;

an atomization chamber, the paint and the atomization air hose fittings terminating within the paint atomization chamber, for atomizing paint from the paint source with the atomizing air from the atomizing air source; and a shaping air exit port in fluid communication with the shaping air hose fitting, sized and configured to direct shaping air in a direction of paint atomized in the paint atomization chamber.

13. An extended nozzle assembly for use with a high volume, low pressure paint spray gun connectable to a paint source, an atomization air source and a shaping air source, the paint spray gun having a spray gun body in fluid communication with the paint source, the atomization air source for atomizing paint and the shaping air source for shaping paint spray patterns, the extended nozzle assembly comprising:

a nozzle defining a paint atomizing zone for discharging atomized paint and a paint spray pattern shaping zone shaping atomized paint spray patterns;

a paint hose having an inlet end connectable to the spray gun body and a discharge end connectable to the nozzle;

an atomization air hose having an inlet end connectable to the spray gun body and a discharge end connectable to the nozzle;

a shaping air hose having an inlet end connectable to the spray gun body and a discharge end connectable to the nozzle;

a bendable, shape-retaining paint conduit having an inlet port connectable to the spray gun body and an outlet port connectable to the nozzle, the hoses extending therethrough and contained therein; and wherein the paint conduit allows the nozzle to be self-supporting for maintaining the paint atomizing and shaping zones remote from and at any angle relative to the spray gun body for selectively discharging atomized paint and shaping resulting paint spray patterns thereof.

14. The extended nozzle assembly of claim 13 wherein the paint conduit being rotatably attachable to the spray gun body.

15. The extended nozzle assembly of claim 14 wherein the paint conduit comprises an input coupling for rotatably attaching the paint conduit to the spray gun body.

16. The extended nozzle assembly of claim 13 wherein the paint conduit being rotatably attachable to the nozzle.

17. The extended nozzle assembly of claim 16 wherein the paint conduit comprises an output coupling for rotatably attaching the paint conduit to the nozzle.

18. A high volume, low pressure method of painting comprising the steps of:

(a) providing a high volume, low pressure paint spray gun connectable to a paint source, an atomization air source and a shaping air source, the paint spray gun comprising:

a spray gun body in fluid communication with the paint source, the atomization air source for atomizing paint and the shaping air source for shaping paint spray patterns;

a nozzle defining a paint atomizing zone for discharging atomized paint and a paint spray pattern shaping zone shaping atomized paint spray patterns;

a paint hose having an inlet end connected to the spray gun body and a discharge end connected to the nozzle;

an atomization air hose having an inlet end connected to the spray gun body and a discharge end connected to the nozzle;

a shaping air hose having an inlet end connected to the spray gun body and a discharge end connected to the nozzle;

a bendable, shape-retaining paint conduit having an inlet port connectable to the spray gun body and an outlet port connectable to the nozzle, the hoses extending therethrough and contained therein; and wherein the paint conduit allows the nozzle to be self-supporting for maintaining the paint atomizing and shaping zones remote from and at any angle relative to the spray gun body for selectively discharging atomized paint and shaping resulting paint spray patterns thereof, (b) selectively bending the paint conduit; and (c) selectively discharging atomized, shaped paint from the paint spray gun.

* * * * *